US005360132A

United States Patent [19]

Edelhoff

[11] Patent Number: 5,360,132

[45] Date of Patent: Nov. 1, 1994

[54] COLLECTING CONTAINER FOR WASTE

[75] Inventor: Gustav D. Edelhoff, Iserlohn, Germany

[73] Assignee: Edelhoff Polytechnik GmbH, Iserlohn, Germany

[21] Appl. No.: 937,594

[22] Filed: Aug. 31, 1992

[30] Foreign Application Priority Data

Sep. 2, 1991 [DE] Germany ..... 4129163

[51] Int. Cl.[5] ..... B65D 43/14

[52] U.S. Cl. ..... 220/334; 220/252; 220/254; 220/346; 220/908

[58] Field of Search ..... 220/213, 254, 345, 252, 220/331, 342, 346, 908, 334, 315, 317, 318; 232/43.1, 43.4; 137/45

[56] References Cited

U.S. PATENT DOCUMENTS

| | | | |
|---|---|---|---|
| 968,828 | 8/1910 | Beckley | 220/252 X |
| 1,300,710 | 4/1919 | Edwards | 220/252 |
| 1,887,345 | 11/1932 | Coors | 220/213 |
| 1,938,519 | 12/1933 | Deffenbaugh | 220/252 X |
| 2,702,721 | 2/1955 | Dempster . | |
| 3,240,038 | 3/1966 | Schwegler | 220/252 X |
| 4,280,780 | 7/1981 | Neufeldt . | |
| 4,401,312 | 8/1983 | Parker | 220/908 X |
| 4,406,395 | 9/1983 | Scoggins | 232/43.1 |
| 4,589,546 | 5/1986 | Sunderland | 220/252 X |
| 4,609,117 | 9/1986 | Pamment | 220/252 |
| 4,732,295 | 3/1988 | Horinchi | 220/331 |
| 4,859,135 | 8/1989 | Neufeldt . | |
| 4,878,596 | 11/1989 | Cawley et al. | 220/331 |
| 5,118,005 | 6/1992 | Onodera | 220/501 |

FOREIGN PATENT DOCUMENTS

| | | |
|---|---|---|
| 358478 | 9/1980 | Austria . |
| 1072511 | 2/1980 | Canada . |
| 0011297 | 5/1980 | European Pat. Off. . |
| 1101273 | 3/1961 | Germany . |
| 1893060 | 3/1964 | Germany . |
| 793959 | 11/1964 | Germany . |
| 3614992 | 10/1991 | Germany . |

*Primary Examiner*—Allan N. Shoap
*Assistant Examiner*—Vanessa Caretto
*Attorney, Agent, or Firm*—Morgan & Finnegan

[57] ABSTRACT

A collecting container (20) for waste, such as waste to be recycled, consisting of a container bin (1) provided with a lid (4) which functions to close the opening of the bin and is pivoted thereon so that the lid may be swung between a closed position and an open position. So that the container may be easily filled without difficulty, the container (20) is provided with at least one additional smaller opening, such as openings (8, 8').

3 Claims, 2 Drawing Sheets

COLLECTING CONTAINER FOR WASTE

This invention relates to a collecting container for waste. More particularly, the invention relates to a collecting container for waste to be recycled and which consists of a container bin provided with a lid which functions to close the opening of the bin and is pivoted thereon so that the lid may be swung between a closed position and an open position.

BACKGROUND OF THE INVENTION

Large-volume collecting containers of this type generally up to now have the disadvantage in that they are provided with lids that are difficult to manipulate, thus being awkward for old and weak people to operate.

There exists, therefore, a need to provide large-volume collecting containers for waste which do not exhibit such disadvantage.

Accordingly, one object of the present invention is to provide a large-volume collecting container of this type, which may be filled without difficulty.

BRIEF STATEMENT OF THE INVENTION

In accordance with the invention, this object is attained by providing a collecting container having at least one additional filling opening.

The collecting container in accordance with the invention is, consequently, provided with a conventional lid for closing a large opening, which, in a conventional manner, is opened mainly for the purpose of emptying of the container into a waste collecting vehicle using conventional lifting and tipping means. In this respect, conventional sockets for gripper claws and/or support pins are provided on an edge of the container for lifting and rocking the container to empty the same, and pins or rollers are provided on the end for operation of the lid.

In accordance with the invention, the collecting container is provided with at least one additional smaller opening which serves only for the filling thereof. This smaller filling opening may be used for refuse without having to operate the heavy lid, which shuts off the opening that serves for emptying the container. The additional smaller opening for receiving refuse may be provided in a piece of cover sheet material which shuts off the container bin member and which covers the container bin member only to the extent that the same is not shut off by the large lid used for emptying of the container.

The invention is applicable to large-volume containers with hinged lids and, however, with a particular advantage, applicable to a collecting container with a lid in the form of a partially cylindrical shell, which is provided at its ends with radially inwardly extending arms or flat bars that are hinged on opposite sides of the container bin adjacent to the axis of curvature of the lid with the bin being substantially rectangular. In the case of such collecting containers, which in practice have many different designs, (see, for instance, German Patent Publication 1,871,171 U and German Patent Publication 2,616,865 A), the object in accordance with the invention is attained since the container bin is provided with an opening adjacent to the edge parallel to the hinge axis, the length of such opening being equal to the breadth or the length of the substantially rectangular container bin and which is limited or defined by a border which is parallel to the edge of a sheet of material shutting off the rest of the opening of the bin, such sheet material being arranged adjacent to longitudinal median axis of the bin, and in which sheet material the at least one additional smaller opening is arranged. The border limiting or defining the opening serving for emptying the container is, in this respect, so designed that it abuts the inner surface of the curved wall of the lid so that there is essentially no gap left between the sheet material and the lid.

It is conveniently preferable that the sheet material is in the form of a slanting roof so it rises at an angle and is connected with the edge of the container bin opposite to the opening edge of the container bin. The inner border or edge of the sheet material is expediently adjacent to the apex of the circular segment curve described by the lid on opening and closing thereof so that the inner border makes direct sealing contact with the inner wall surface of the lid which is in the form of a partially cylindrical shell. Optionally, sealing strips may also be provided at the inner border of the sheet material and lid where they contact each other.

The wedge-like lateral area between the sheet material and the edge of the bin is shut off by a triangular wall. It is conveniently preferable that this triangular wall be continued by sheet material starting generally approximately at the longitudinal median plane of the bin over the breadth of the opening with the upper edge of the sheet material being curved in accordance with the curvature of the lid in the form of a partially cylindrical shell.

In accordance with a further feature of the invention the at least one additional opening is surrounded by an upwardly extending flange. This upright rib-like flange prevents rainwater from entering through the opening when, as is likely, the container is left uncovered in the open air.

The additional opening may be provided with a hinged lid to shut it off from the outside and which may be simply and easily operated owing to the small size of the additional opening.

The small size of the additional opening or openings which serve for filling the container provides an additional advantage since, despite the large volume of the container, small articles may be placed in the container through the same, which articles, for example, are suitable for recycling. The undesired use of the bin for bulky objects is, therefore, prevented.

The advantage of the provision of the at least one additional opening or openings, that is the prevention of insertion of bulky objects in the container, would be lost, if users had to open the large lid as well for the purpose of filling the container.

At the edge of the large opening, sockets are provided for reception of gripping means of a lifting and tipping device.

It is also an advantage, in accordance with a separate feature of the invention, that the lid be provided with a locking means which automatically releases on rocking the container about a pivot axis parallel to the pivot axis of the lid. In accordance with such an arrangement, the lid can only be opened when emptying the collecting container and no improper opening by a user is possible.

A further advantageous feature of the invention is the provision of locking means consisting of a gravity pendulum which is able to pivot about an axis parallel to the pivot axis on at least one wall of the container with the pendulum being provided with a hook-like tail that in the shut or closed position of the lid fits behind a locking pin arranged on a pivot arm. Pivoting the container for the purpose of emptying the same causes the gravity pendulum to move into a position which unlocks the lid.

It is conveniently preferred that in the locked position the locking pin and the pivot axis of the pendulum are generally in the same horizontal transverse axis of the container wall. Such an arrangement ensures that the lid of the container when standing on uneven ground cannot be opened, even when subjected to considerable force.

In order to prevent major damage to the container should the pendulum not release the locking pin on tipping, the locking pin is preferably provided with an intentionally weak point or breaking point at which it may relatively easily be broken.

In accordance with a further advantageous feature of the invention, a strip spring is secured on at least one side of the bin adjacent to pivot axis, one end of which strip spring extends upwards and fits between two abutments or pins arranged on the pivot arm and which, furthermore, in the closed position of the lid, is biased in the opening direction of the lid and in the open position of the lid is biased in the opposite direction. The strip spring, consequently, makes it easier to open and close the lid.

In order to provide a simple attachment of the strip spring to the container, its lower end may be partly wrapped about a tube member secured to the container and the tube member is provided with a slot in its outer surface along a line parallel to its axis and in which an angled end part of the strip spring is anchored.

The collecting container in accordance with the invention may be manufactured of synthetic resin or sheet metal with sheet metal being preferred.

THE DRAWINGS

In order to understand the invention more fully, reference is directed to the accompanying Drawings which are to be taken in conjunction with the following detailed description of one working embodiment of the invention and in which Drawings.

DESCRIPTION OF A WORKING EMBODIMENT

Figure 1:
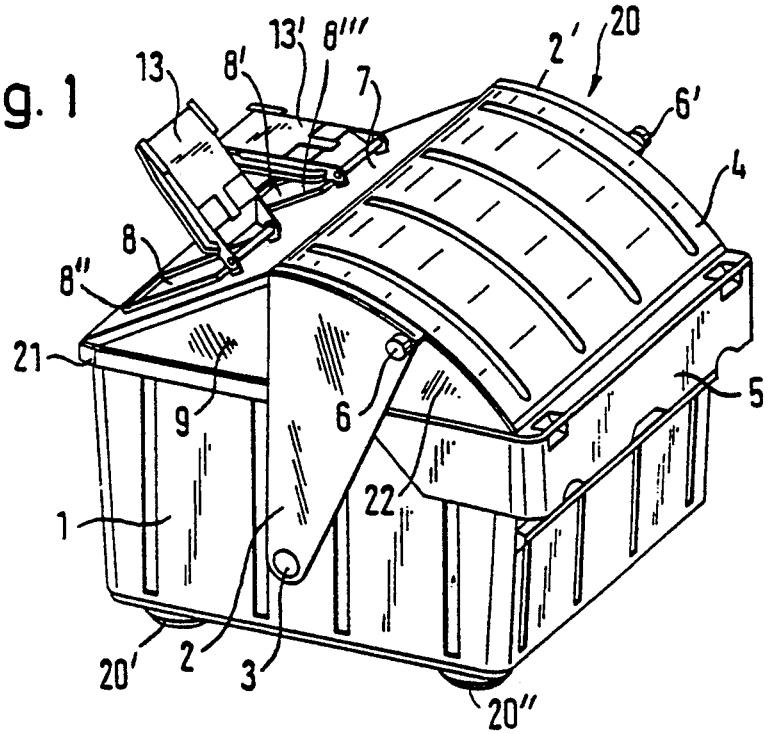
FIG. 1 is an elevational view in perspective of a container according to the invention.

Referring now to FIG. 1, a container according to the invention, which is generally identified by numeral 20, consists of a container bin 1, or tub, which, for example, may have a volume of 1.1 cubic meters and, optionally, is provided with supporting members, such as legs 20' and 20''. The upper edge of the bin is stiffened or strengthened by a surrounding flange 21. At the front end of the bin 1 an apron is connected with the container edge and constitutes a conventional socket 5 for the reception of the gripper claws of the lifting and tipping gear of a shaking device of a refuse carrying vehicle.

Adjacent to the edge of the container bin 1, which is provided with the apron, the bin, is provided with an opening which extends over almost one half of the orifice of the bin which is surrounded by the edge flange 21. This opening is closed by a lid 4 which is in the form of a partially cylindrical shell and which, at its edges, which are curved at the end, is connected with flat bars or pivot arms 2 and 2'. The arms 2 and 2' are pivoted for rocking about mutually aligned pivot pins, one such pin being identified by numeral 3, which are provided in oppositely arranged end walls of the container. At the upper ends of the sector-like pivot arms 2 and 2' rollers 6 and 6' provided with bearings and supported on pins, are provided and which, on tipping of the container by means of the lifting and tipping device of the refuse carrying vehicle, run down on abutments or rails located on the lifting and tipping device (not shown), which serve for opening of the lid.

The container bin 1 is also shut off from the outside by a roof-like, slanting piece of sheet material 7 opposite to the opening which is shut off by the lid 4. Between the lateral edges of the sheet material 7 and the surrounding edge 21 of the bin, triangular pieces of sheet material 9 are provided to shut off the respective gaps along the sides of the container 20.

The sheet material 7 is provided with at least one and preferably with two smaller rectangular filling openings 8 and 8', the edges of such openings being limited or defined by upwardly extending surrounding flanges 8'' and 8'''. The openings 8 and 8' for putting refuse into the container 20 are provided with hinged lids 13 and 13', which are pivoted at the upper edges of the openings.

Pieces of sheet material 22 are arranged next to the triangular pieces of sheet material 9 which shut off the gaps or openings between the roof portion of sheet material 7 and which limit or define the opening, which is shut off by the lid 4, on opposite sides of the container. The upper edges of the pieces of sheet material 22 are curved in accordance with the curvature of the lid 4.

Figure 2:
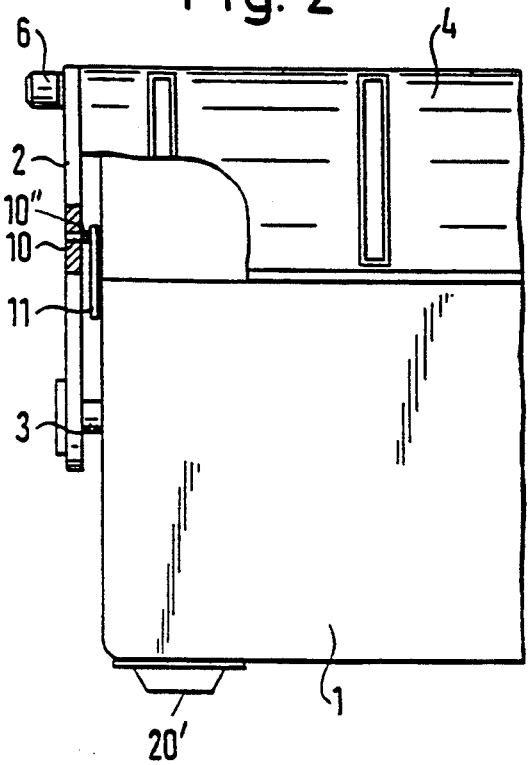
FIG. 2 is a partial front, elevational view, partly in section of the container illustrated in FIG. 1.
Figure 3:
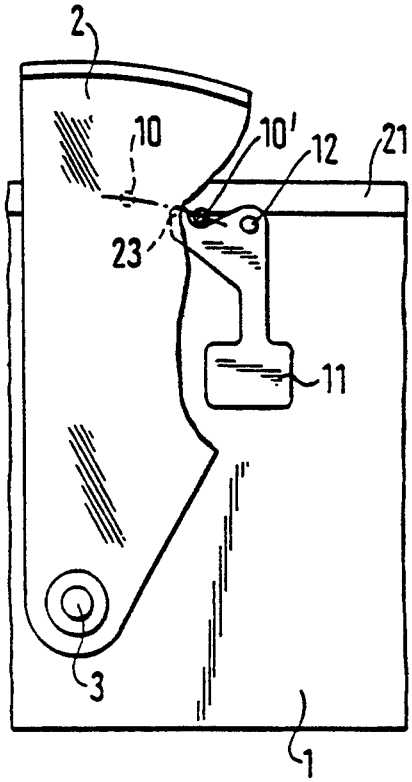
FIG. 3 is a partial side elevational view partly in section of the container illustrated in FIG. 1.

As may be seen from FIGS. 2 and 3, inwardly directed pins 10 are arranged on the inner side of the pivot arms, such as arm 2, bearing the lid 4. In the closed position of the lid such pins are cradled in a hook-like socket 10' of the hook-like tail or prolongation 23 of a gravity pendulum 11 which is pivoted on a pin 12 located in the upper edge portion of the container wall for rocking movement thereabout. The gravity pendulum 11 is covered over by the pivot arm 2, which is in the form of a flat bar when the lid 4 is in the closed position, thus preventing unauthorized use of the pendulum.

In FIG. 3, the pin 10 locking the lid is illustrated in a disengaged position and in its locked position in socket 10'.

The locking pin 10 may be provided on one or both sides of the container 20 and preferably is provided with an intentional weak point 10'' (FIG. 2) at which it may relatively easily be broken, if the pendulum is not able to move freely owing to damage or becoming jammed.

Figure 4:
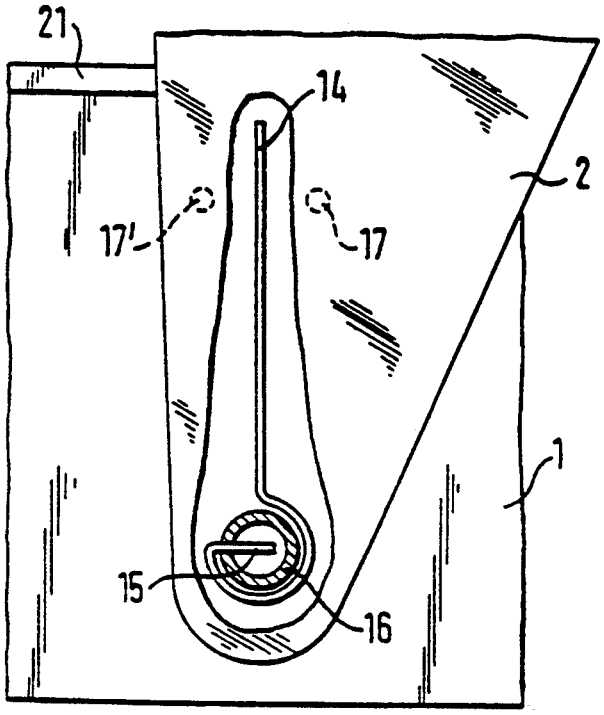
FIG. 4 is a partial elevational view of the arrangement illustrated in FIG. 3 with part of the pivot arm broken away to expose the arrangement of the strip spring.

In the illustrated working embodiment shown in FIG. 4, an upwardly extending strip spring 14 is attached to a tube member 16 mounted adjacent to the pivot axis 3 on the wall of the container 20. The strip spring 14 is fixed by being wrapped about a part of the tube member 16 and an angled end thereof 15 fits into a slot in the tube member.

The upwardly projecting strip spring 14 extends between two pins 17 and 17' secured to the inner side of the pivot arm 2. In this respect, the strip spring is so arranged that it acts on the lid in the closed position to urge it into its open position, while in the open position it urges it towards it closed position. Having such a strip spring on one or both sides means, therefore, that the lid may be more easily opened for emptying contents from the container and may be more readily closed after emptying thereof.

What is claimed is:

1. A collecting container (20) comprising a bin (1) having a plurality of walls and an opening provided with a lid (4) having pivot arms (2) which are pivoted on pivot pins (3) located on said bin (1) and which form a pivot axis for said lid (4), said lid (4) being movable about said pivot axis to a closed position covering said opening and an open position permitting access to said bin and removal of contents therefrom, and locking means comprising a locking pin (10) located on one said pivot arm and a gravity pendulum (11) located on at least one wall of said bin (1) and pivoting about an axis (12) disposed parallel to said pivot axis to locked and unlocked positions, said gravity pendulum (11) provided with a hook-like tail (23) which in locked position fits behind said locking pin (10) located on said one pivot arm.

2. A collecting container according to claim 1 wherein in locked position said locking pin (10) and said axis (12) of said gravity pendulum (11) are generally in a common horizontal transverse plane of said container bin (1).

3. A collecting container according to claim 1 wherein said locking pin (10) is frangible.

* * * * *